United States Patent [19]

Kawaguchi

[11] 3,942,834

[45] Mar. 9, 1976

[54] HOOKED CLUTCH

[75] Inventor: Yasuzi Kawaguchi, Sakai, Japan

[73] Assignee: Nittan Kohki Kabushiki Kaisha, Sakai, Japan

[22] Filed: Mar. 6, 1975

[21] Appl. No.: 555,937

[30] Foreign Application Priority Data

June 14, 1974 Japan ..... 49-68492
Oct. 18, 1974 Japan ..... 49-126293

[52] U.S. Cl. ..... 294/110 R; 294/106
[51] Int. Cl.[2] ..... B66C 1/64
[58] Field of Search ..... 294/83 R, 85, 90, 106, 294/108, 110 R, 110 B, 111, 112, 115

[56] References Cited

UNITED STATES PATENTS

| | | | |
|---|---|---|---|
| 1,673,237 | 6/1928 | Gerdes | 294/110 R |
| 2,629,627 | 2/1953 | Stone | 294/110 R |
| 2,958,557 | 11/1960 | Cianchette | 294/106 |
| 3,455,593 | 7/1969 | Moro | 294/110 R |

*Primary Examiner*—Evon C. Blunk
*Assistant Examiner*—Johnny D. Cherry
*Attorney, Agent, or Firm*—George B. Oujevolk

[57] ABSTRACT

A hooked clutch for use with a crane, a hoist or the like is disclosed which includes a pair of clutching arms pivoted to a pantagraph on top of which is attached a ring. A pair of slide plates are mounted on the body of the clutch to be slidable along the body for a limited distance. The clutching arms are coupled by chain with the slide plates, which are coupled to, and uncoupled from, the ring. Simply by lifting and lowering the ring, the clutching arms can be automatically closed and opened to cause the hooks at their ends to engage, and disengage from, a member to be transported.

3 Claims, 15 Drawing Figures

HOOKED CLUTCH

The present invention relates to a hooked clutch for use with a crane, a hoist or the like for lifting and transporting structural members having a projecting portion at each side thereof, such as I-steels.

On conventional clutches, clutching hooks had to be folded and spread out by hand to bring them into and out of engagement with the member to be transported. This means very low efficiency and incomplete clutching which may lead to serious accident.

It is an object of the present invention to provide a clutch whose clutching hooks can be automatically opened and closed simply by lifting and lowering a ring on its top by remote control to bring a portion of the clutch into contact with the member to be transported.

It is another object of the present invention to provide a clutch which includes a means for assuring secure opening and closing of the clutching hooks.

Other objects and advantages of the present invention will become apparent from the following description of embodiments with reference to the accompanying drawings in which.

Figure 1:
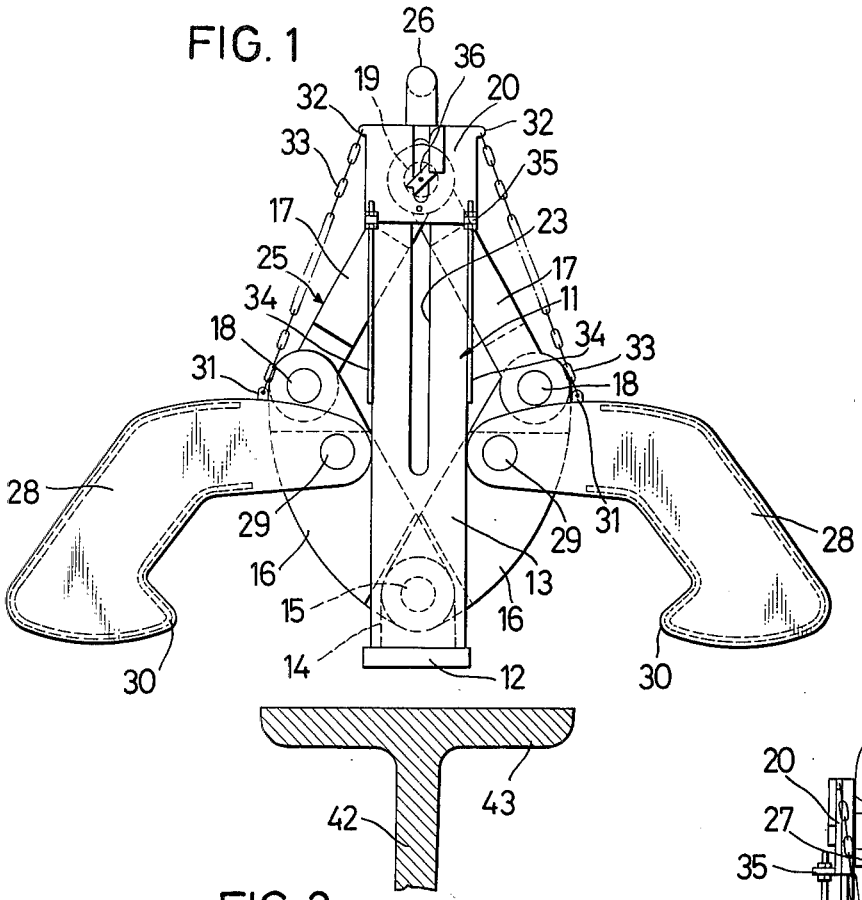
FIG. 1 is a front view of a hooked clutch in accordance with the present invention.
Figure 2:
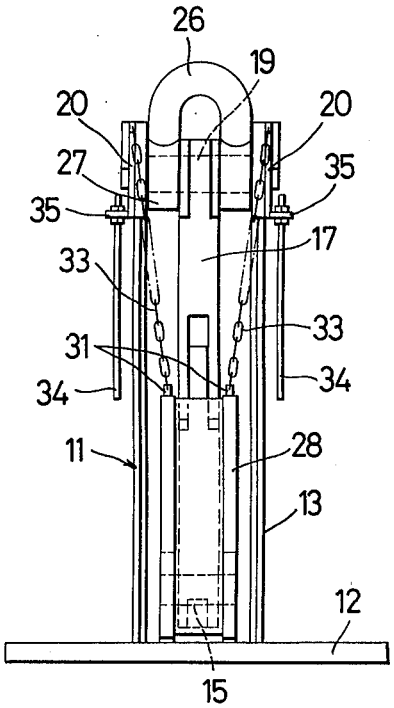
FIG. 2 is a side view thereof.
Figure 4:
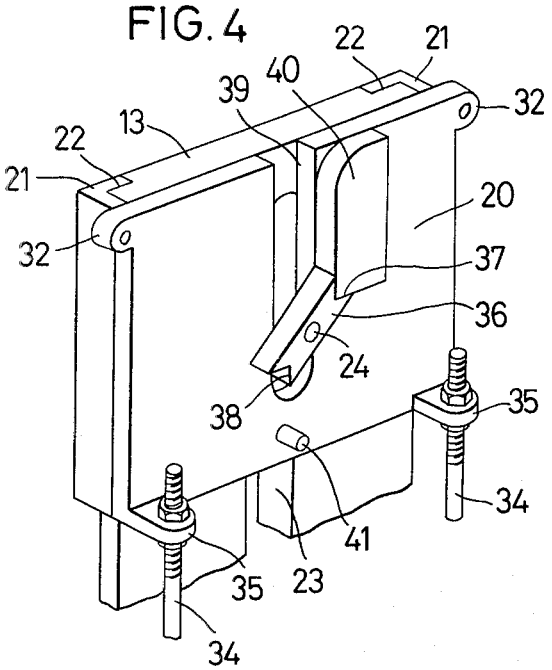
FIG. 4 is an enlarged perspective view of a portion thereof.
Figure 9:
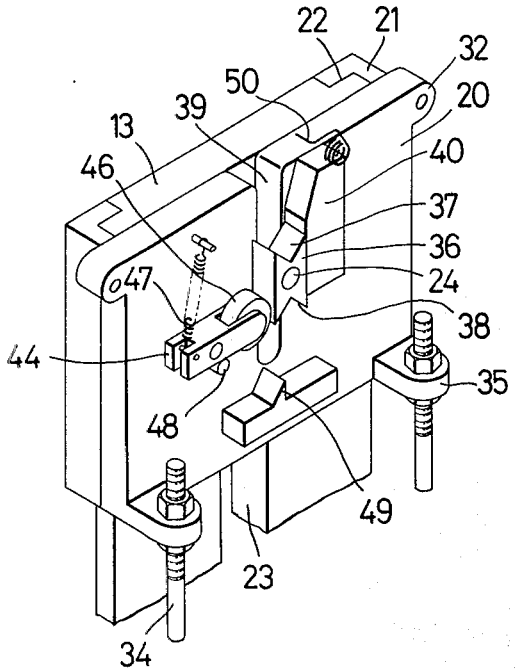
Figure 11:
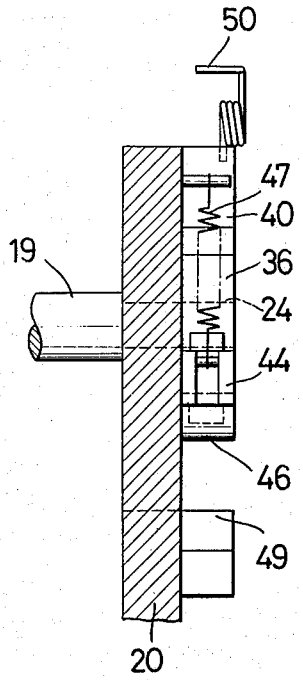
Figure 10:
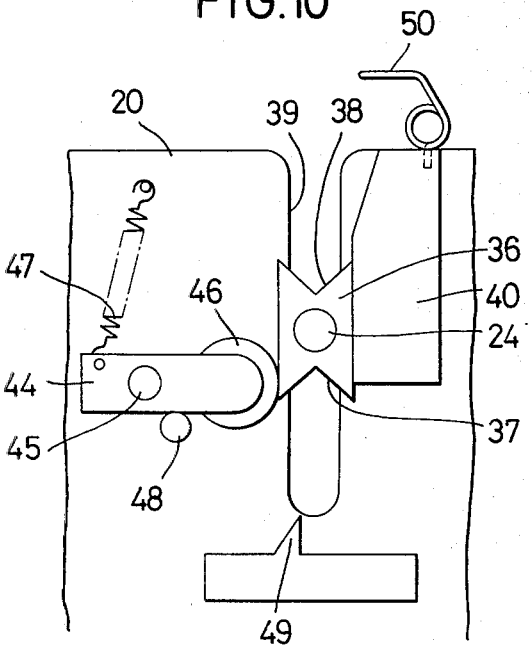
Figure 12:
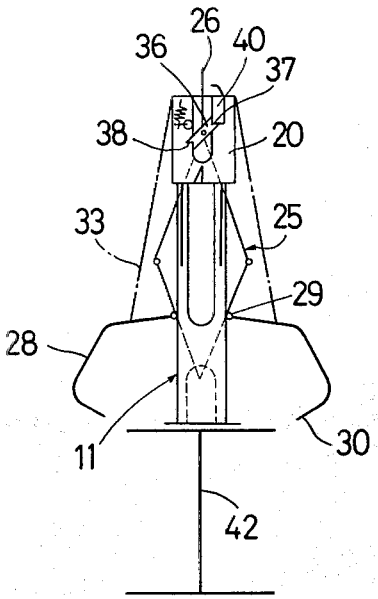
Figure 13:
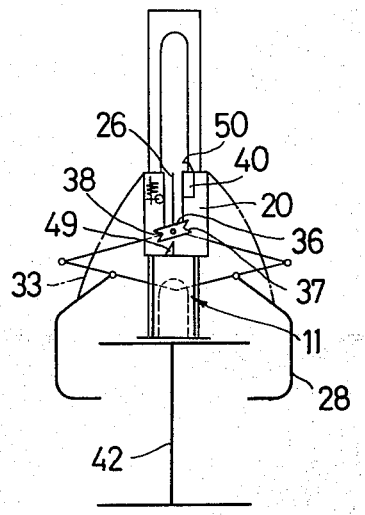

FIGS. 5, 6, 7 and 8 schematically show the operation of the clutch shown in FIG. 1;

FIG. 9 is an enlarged perspective view similar to FIG. 4 of a portion of another embodiment of the present invention;

FIG. 10 is a further enlarged partial front view of the portion shown in FIG. 9;

FIG. 11 is a longitudinal cross-sectional side view of the portion shown in FIG. 10; and FIGS. 12, 13, 14 and 15 are diagrams similar to FIGS. 5, 6, 7 and 8 schematically showing the operation of the second embodiment shown in FIG. 9.

In the embodiment shown in FIG. 1 to FIG. 8, the numeral 11 designates a body of the device embodying the present invention. The body 11 consists of a pair of side plates 13 mounted vertically opposite to each other on a bottom plate 12 and secured thereto as by welding. An opposed pair of bearings 14 are also secured to the bottom plate 12 between the side plates 13. On a horizontal axis 15 journalled by the bearings 14 are pivoted the lower ends of a pair of supporting plates 16, to the upper ends of which are pivoted the lower ends of a pair of links 17 on shafts 18. The links 17 have their upper ends mounted on a shaft 19. Thus, the supporting plates 16 cooperate with the links 17 to form a pantagraph 25.

A slide plate 20 is mounted on the outer side of each side plate 13 so as to be slidable therealong. An opposed pair of guides 21 of L-shape cross-section are secured to the rear of said each slide plate 20 at both ends thereof. The guides 21 are slidably fitted in their respective vertical guide channels 22 formed in both ends of the rear of each side plate 13 to permit vertical sliding movement of the slide plate 20.

Each side plate 13 is formed with a vertical elongated slot 23 at the center thereof, in which a projection 24 of a smaller diameter on each end of the shaft 19 is loosely fitted. The projections 24 on the ends of the shaft 19 are also loosely fitted in vertical elongated slots formed in the slide plates 20 at the center thereof from the top edge thereof, too. The numeral 26 designates a ring of inverted U-shape, two circled ends 27 of which are mounted on the shaft 19 between the links 17 and the side plates 13.

An opposed pair of clutching arms 28 curving at the middle thereof have their upper ends pivoted to the supporting plates 16 on shafts 29. The clutching arms 28 each have their lower end formed to serve as a clutching hook 30. The clutching arms 28 each are provided with two projections 31 on the top edge thereof adjacent to the shafts 29. The slide plates 20 also are provided with two projections 32 on their top edge. The projections 31 on the clutching arms 28 are coupled to the respective projections 32 on the slide plates 20 by chains 33. Chains may be replaced by any other flexible members such as wire rope. The slide plates 20 are provided with rods 34 with their upper end secured to mounting portions 35 projecting outwardly from the bottom edges of the slide plates 20. The slide plates 20 can be lowered until these rods 34 contact the bottom plate 12.

An actuator 36 is pivotally mounted on the tip of the projection 24 on each end of the shaft 19. These actuators 36 are formed with V-shaped notches 37 and 38 at their ends.

A stopper 40 is fixed to the outer surface of each slide plate 20 with its left-hand side facing the elongated slot 39. The stopper 40 has its one top corner facing the elongated slot 39 rounded, while its opposite bottom corner is formed to be of such an angle as to fit in the notch in the actuator 36 when the latter is in a slightly inclined position.

The actuator 36 in a vertical position goes up and down the side of the stopper 40 facing the elongated slot 39. A pin-like changeover projection 41 is fixed to the outer surface of each slide plate 20 at its lower portion, slightly eccentric from the axis of the elongated slot 39 in the opposite direction to the stopper 40.

The operation of a preferred embodiment will now be explained. Although the slide plate, actuator, stopper, changeover projection, etc. are all provided in pairs, they will be sometimes referred to in singular in the following description for the sake of simplicity.

Figure 3:
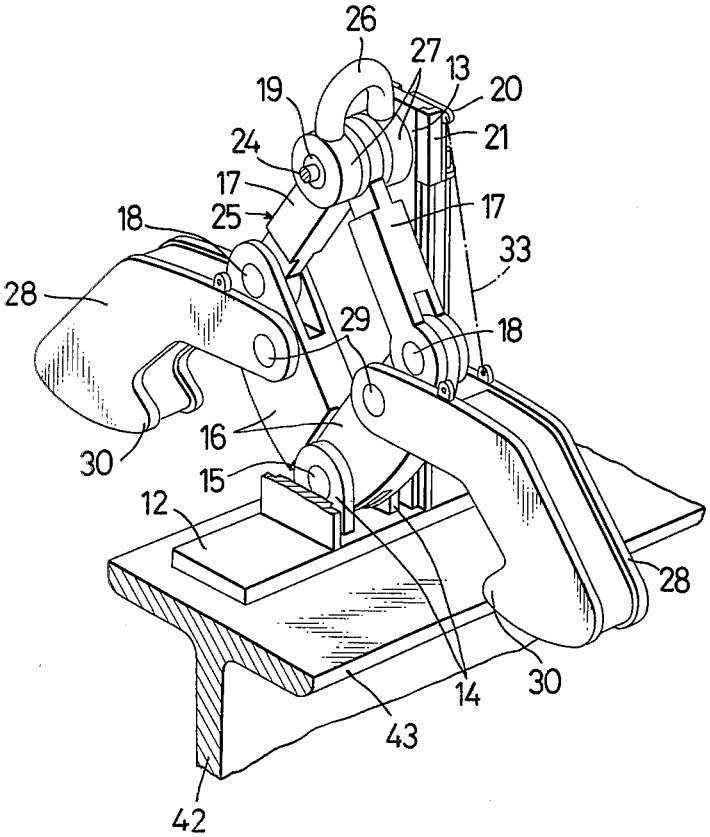
FIG. 3 is a perspective view thereof.
Figure 5:
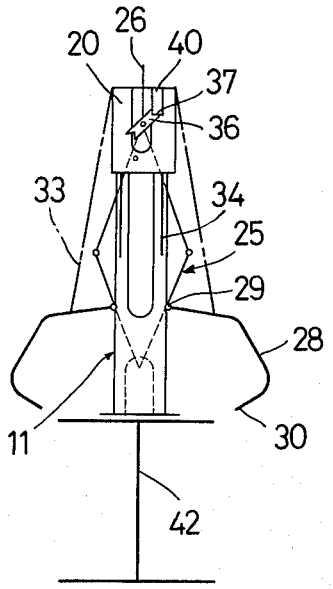
Figure 6:
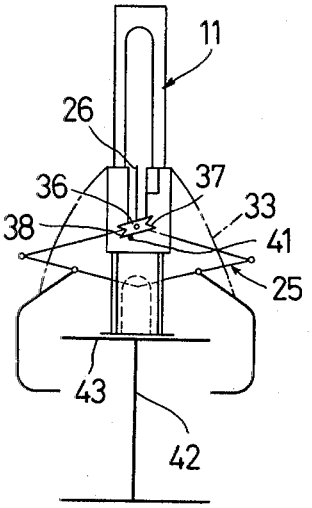

When the ring 26 is lifted as by a crane with the actuators 36 slightly tilted to the right in engagement with the stopper 40 at their one notched end as shown in FIGS. 4 and 5, the pantagraph 25 extends under the weight of the body 11, pantagraph 25, arms 28 and other members and the slide plates 20 go up relative to the body 11. The chains 33 pull up the clutching arms 28 into a full-open position as shown in FIGS. 1, 3 and 5.

The ring 26 is then lowered. After the bottom plate 12 has contacted the top of an I-steel 42, the ring 26 further goes down. The slide plates 20 will start to slide down with the ring 26 so that the pantagraph 25 contracts. Even after the rods 34 have contacted the bottom plate 12 to stop the slide plates 20, the ring 26 further goes down. As the chains 33 loosen, the clutching arms 28 pivot down around the shafts 29 under their own weight until the clutching hooks 30 come under the upper beam 43 of the I-steel 42 as in FIG. 6. When the ring 26 further comes down, the actuator 36 hits the changeover projection 41 on its rigt-hand side, pivoting to the right into a near-horizontal position as in FIG. 6.

Figure 7:
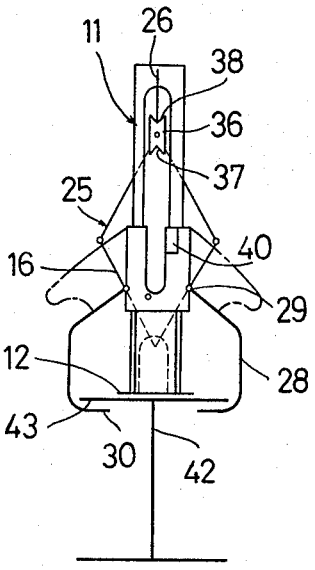
Figure 8:
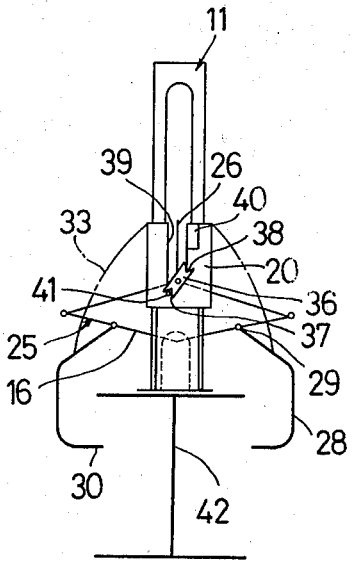

When the ring 26 is then pulled, it will go up, leaving the slide plates 20 and the body 11. On its way up, the actuator 36 hits the stopper 40 on its right-hand side to pivot into a vertical position, and goes up the slot 39 along the stoppers 40 with its notch 37 turned down. Therefore, even though the ring 26 goes up to extend the pantagraph 25, the chains 33 remain loosened. As the pantagraph 25 extends, the distance between the arms 28 and that between the shafts 29 decrease. Accordingly, the clutching hooks 30 engage the I-steel 42 on the underside of its upper beam 43 from both sides as shown in FIG. 7. As the ring 26 is further lifted, the slide plates 20 and the body 11 also start to go up so that the I-steel 42 is hoisted off the ground.

After the I-steel 42 has been transported to a desired position, the ring 26 is lowered until the I-steel 42 contacts the ground. As the ring 26 further goes down with the body 11 and the slide plates 20 on the upper beam 43 of the I-steel 42, the pantagraph 25 contracts to pivot down the supporting plates 16. The arms 28 spread out to release the I-steel 42 from the clutching hooks 30.

With further lowering of the ring 26, the projections 24 on both ends of the shaft 19 fit in the elongated slots 39 in the slide plates 20. When it further goes down, the actuator 36 engages the projection 41 on its lower notch 37. Because of slightly eccentric position of the projection 41, the actuator 36 slightly pivots to the right into a position ready to engage the stopper 40 on its upper notched end.

When the ring 26 is then pulled up, the actuator 36 goes up with the ring 36 into engagement with the stopper 40 on its upper notch 38 to couple the slide plate 20 with the ring 26. Thus, the slide plate 20 starts to go up with the ring 26. The chains 33 pull the arms 28, which pivot up around the shafts 29, clearing the I-steel 42. The body 11 also goes up until the device in accordance with the present invention completely comes off the I-steel 42.

Since another embodiment as shown in FIGS. 9 to 15 is substantially the same as the first embodiment described above except for some minor portions, only the modified portions will be explained below.

In the second embodiment shown in FIGS. 9 to 11, the lever 44 is pivoted to the outer side of each slide plate 20 on the shaft 45, opposite to the stopper 40. On the front end of the lever 44 is pivoted a roller 46, opposite to the stopper 40. To the rear end thereof is attached a spring 47 to hold it horizontal. The other end of the spring 47 is connected to the slide plate 20. A stopper pin 48 is fixed to the slide plate 20 to support the lever 44 horizontally, leaving a gap equal to the width of the actuator 36 between the roller 46 and the stopper 40. Under the elongated slot 39 is provided a pointed-tipped changeover projection 49, which has the same function as the changeover projection 41 on the first embodiment. It also is in a similar eccentric position with respect to the axis of the slot 39. A correcting piece 50, which may be formed by bending a metal piece, is fixed to the top of the stopper 40 with its coiled base thereon and its tip slightly withdrawn from the extension line of the side of the stopper 40 facing the roller 46.

The operation of the second embodiment will be explained below. Operation is quite the same as with the first embodiment in FIGS. 12 and 13.

The device comes down on to the I-steel 42 with the actuator 36 in engagement with the stopper 40 and the clutching arms 28 in their open position. First the body 11 contacts the I-steel 42. When the slide plate 20 goes down relative to the body 11, the actuator 36 hits the changeover projection 49 on its right-hand side, pivoting into a near-horizontal position.

Figure 14:
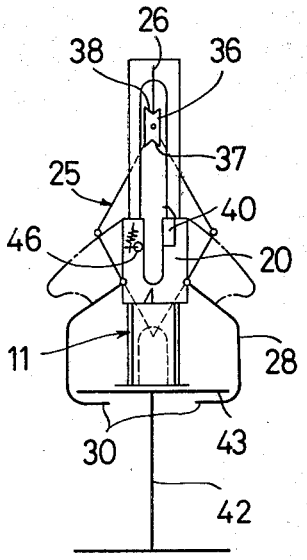
Figure 15:
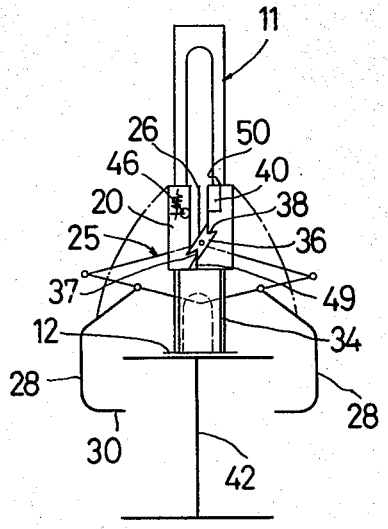

When the ring 26 is then pulled up, the actuator 36 hits the stopper 40 on its right-hand end and pivots to the right into a vertical position while pushing up the roller 46. Although the left-hand end of the actuator 36 hits the roller 46 at its bottom, the lever 44 pivots up against the force of the spring 47. The actuator 36 goes up in a substantially vertical position with the notch 38 up and the upper beam 43 of the I-steel 42 clamped between the clutching hooks 30 and the bottom plate 12 as shown in FIG. 14. This condition is the same as in FIG. 7.

The I-steel 42 is transported thus suspended. When it arrives at a desired position, the ring 26 is lowered. First the I-steel 42 contacts the ground and then the slide plate 20 goes down until the rods 34 extending from the bottom thereof contact the bottom plate 12. The ring 26 further goes down. Held in a vertical position, the actuator 36 passes between the roller 46 and the stopper 40 until it hits the changeover projection 49 on its notched end into a slightly inclined position as in FIG. 15. The pantagraph 25 has contacted and thus the arms 28 have spread out. When the ring 26 is then raised, first the actuator 36 goes up into engagement with the stopper 40. Thereafter the slide plate 20 goes up with the actuator 36 to stretch the pantagraph 25 and tighten the chains 33. Thus the arms 28 open and clear the upper beam 43 of the I-steel 42.

When the actuator 36 comes down toward the slide plate 20 (as in FIG. 14), it may not be vertical but inclined. If it is inclined with its bottom slightly deflecting to the right, the correcting piece 50 pushes its bottom leftward to return it to a vertical position. The stopper 40 and the roller 46 also serve to bring it back to its normal position. If the actuator 36 comes down inclined in the reverse direction, the correcting piece 50 pushes its stop leftward for the same purpose.

As described above, the present invention provides a hooked clutch whose clutching arms can be automatically spread out and folded to cause their hooks to disengage from the member to be transported and engage the same simply by lifting and lowering a ring on top of pantagraph formed by a pair of links and supporting plates to which the clutching arms are pivoted.

The hooked clutch according to the present invention is simple to operate and requires no skill. It greatly increases work efficiency compared with conventional clutches which require manual engagement and disengagement of the hooks. Structural members are transported securely clamped between the bottom plate 12, the inner sides of the clutching arms 28, and the clutching hooks 30 thereof. There is no possibility of members falling off the hooks during transportation, causing accident.

Although the preferred embodiments have been described in connection with I-steel, it is to be understood that the device according to the present invention can be employed to lift and transport any other members having projecting portions under which the hooks engage.

What is claimed is:

1. A hooked clutch comprising a body including an opposed pair of side plates vertically mounted on a bottom plate, a pantagraph formed by an opposed pair of links and an opposed pair of supporting plates, a ring having its lower ends mounted on a shaft on which the top of said pantagraph also is mounted, said pantagraph having its lower end coupled to said bottom plate of the body, an opposed pair of clutching arms pivoted to said supporting plates at the upper end thereof and having their lower end formed to be a hook, said hooks being disposed opposite to each other, an opposed pair of slide plates mounted to said side plates to be slidable therealong for a limited distance, members for coupling said clutching arms with said slide plates, and automatic changeover means provided on said ring and said slide plates for alternately coupling said slide plates with said ring and uncoupling the former from the latter.

2. A hooked clutch according to claim 1, wherein said automatic changeover means comprises an actuator mounted on each end of said shaft on which the lower ends of said ring are mounted, said actuators having a V-shaped notch formed in each end thereof, a stopper provided on said each slide plate at the upper portion thereof, said actuators coming into engagement with said stoppers at their notched end to couple said slide plates with said ring when they go up slightly inclined, and hitting said stoppers on their right-hand end and pivoting into a substantially vertical position to leave said slide plates disengaged from said ring when they go up in a near-horizontal position, and an eccentric changeover projection provided on said each slide plate at the lower portion thereof, said each eccentric changeover projection engaging said actuator on its notched end to incline it slightly when said actuator goes down vertically, and pushing said actuator on its side to incline it into a near-horizontal position when it goes down slightly inclined.

3. A hooked clutch according to claim 1, wherein said automatic changeover means comprises an actuator mounted on each end of said shaft on which the lower ends of said ring are mounted, said actuators having a V-shaped notch formed in each end thereof, a stopper provided on said each slide plate at the upper portion thereof, said actuators coming into engagement with said stoppers at their notched end to couple said slide plates with said ring when they go up slightly inclined, and hitting said stoppers on their right-hand end and pivoting into a substantially vertical position to leave said slide plates disengaged from said ring when they go up in a near-horizontal position, an eccentric changeover projection provided on said each slide plate at the lower portion thereof, said each eccentric changeover projection, engaging said actuator on its notched end to incline it slightly when said actuator goes down vertically, and pushing said actuator on its side to incline it into a near-horizontal position when it goes down slightly inclined, a lever mounted on said each slide plate opposite to said stopper to be pivotable only upwardly and held in a horizontal position by a spring, a roller rotatably pivoted to said lever at one end thereof to provide a sufficient gap between said roller and said stopper to permit passage of said actuator therebetween, and a correcting piece secured to the top of said each slide plate for bringing said actuator, if it goes down inclined, back to a vertical position.

* * * * *